United States Patent [19]

Bannister

[11] Patent Number: 4,653,563

[45] Date of Patent: Mar. 31, 1987

[54] STRUCTURE INCORPORATING STABILIZING MEANS

[75] Inventor: Brian C. Bannister, North Mimms, England

[73] Assignee: Marley Haley Exposystems Limited, Herts, England

[21] Appl. No.: 654,103

[22] Filed: Sep. 24, 1984

[30] Foreign Application Priority Data

Sep. 29, 1983 [GB] United Kingdom ..... 8326166

[51] Int. Cl.[4] ..... A47G 5/00

[52] U.S. Cl. ..... 160/135; 160/351; 52/232; 52/282

[58] Field of Search ..... 160/135, 351; 52/239, 52/282, 71, 70, 483, 489, 238.1, 721, 585, 243.1; 248/297.2

[56] References Cited

U.S. PATENT DOCUMENTS

| | | | |
|---|---|---|---|
| 1,727,420 | 9/1929 | Walper | 52/489 |
| 3,111,723 | 11/1963 | Bates . | |
| 3,204,689 | 9/1965 | Howell | 160/135 |
| 3,486,287 | 12/1969 | Guillon | 52/239 |
| 3,561,182 | 2/1971 | Madel | 52/483 |
| 3,735,794 | 5/1973 | Lebowitz | 160/135 |
| 3,788,378 | 1/1974 | Sobel | 160/135 |
| 3,848,844 | 11/1974 | Barrett | 248/297.2 |
| 3,971,182 | 7/1976 | Donahue | 160/135 |
| 4,001,987 | 1/1977 | Coulthard | 160/135 |
| 4,194,336 | 3/1980 | Weinar | 52/489 |
| 4,538,784 | 9/1985 | O'Flanagan | 248/297.2 |

FOREIGN PATENT DOCUMENTS

| | | | |
|---|---|---|---|
| 669299 | 4/1952 | United Kingdom | 160/135 |
| 972458 | 10/1964 | United Kingdom . | |
| 2029197 | 3/1980 | United Kingdom | 248/297.2 |
| 1586738 | 3/1981 | United Kingdom . | |

*Primary Examiner*—J. Franklin Foss
*Assistant Examiner*—Robert A. Olson
*Attorney, Agent, or Firm*—Parmelee, Miller, Welsh & Kratz

[57] ABSTRACT

Stabilizing means is disclosed for a structure comprising a plurality of rectangular panels each comprising two transverse members and two uprights, extensions of which, in the form of spigots, project beyond the transverse members at upper and lower ends of the frame and engage in sockets provided by connecting members. The stabilizing means comprises a vertical rail carrying a plurality of connector elements providing sockets receiving spigots of adjacent panels.

7 Claims, 14 Drawing Figures

STRUCTURE INCORPORATING STABILIZING MEANS

BACKGROUND OF THE INVENTION

This invention relates to a structure of the kind comprising a plurality of rectangular panels each comprising two uprights and two transverse members, with extensions of the uprights projecting beyond the transverse members at upper and lower ends of the frame to form elements, (i.e. spigots or sockets) of spigot and socket connections, a plurality of said frames being disposed one above the other so that the uprights of the frames are disposed in vertical arrays, each array comprising a plurality of such uprights in longitudinal alignment with one another, the structure further including connecting means inter-connecting the frames and including means engaging said projecting portions of said uprights and affording the complementary elements of said spigot and socket connections. A structure of the above noted kind is hereinafter referred to as being "of the kind specified".

Our British Patent Specifications Nos. 1586738 and 972458 disclose display structures for use in exhibitions and the like which are of the kind specified.

One difficulty which is sometimes encountered with structures of the kind specified is that because there must necessarily be, to take account of manufacturing tolerances, a certain lateral freedom in the spigot and socket connections, such a structure, in certain configurations, is subject to slight wobbling movements, which in certain circumstances may be unacceptable.

SUMMARY OF THE INVENTION

It is an object of the present invention to provide a structure of the kind specified incorporating stabilising means by which such wobbling movements may be avoided.

According to the invention there is provided a structure of the kind specified incorporating stabilising means comprising a vertical column of substantially constant cross-section throughout its length disposed adjacent and parallel with at least one said vertical array of uprights, a plurality of connector elements engaged with said column and each providing at least one element of a spigot and socket connection receiving the complementary element of such a spigot and socket connection carried by or provided by a said upright of the respective vertical array, the interengagement of each said connector element with said vertical column being such as to prevent removal of the connector element from the column transversely.

BRIEF DESCRIPTION OF THE DRAWINGS

The accompanying drawings illustrate an embodiment of the invention described below by way of example.

In the drawings.

DESCRIPTION OF THE PREFERRED EMBODIMENT

Figure 1:
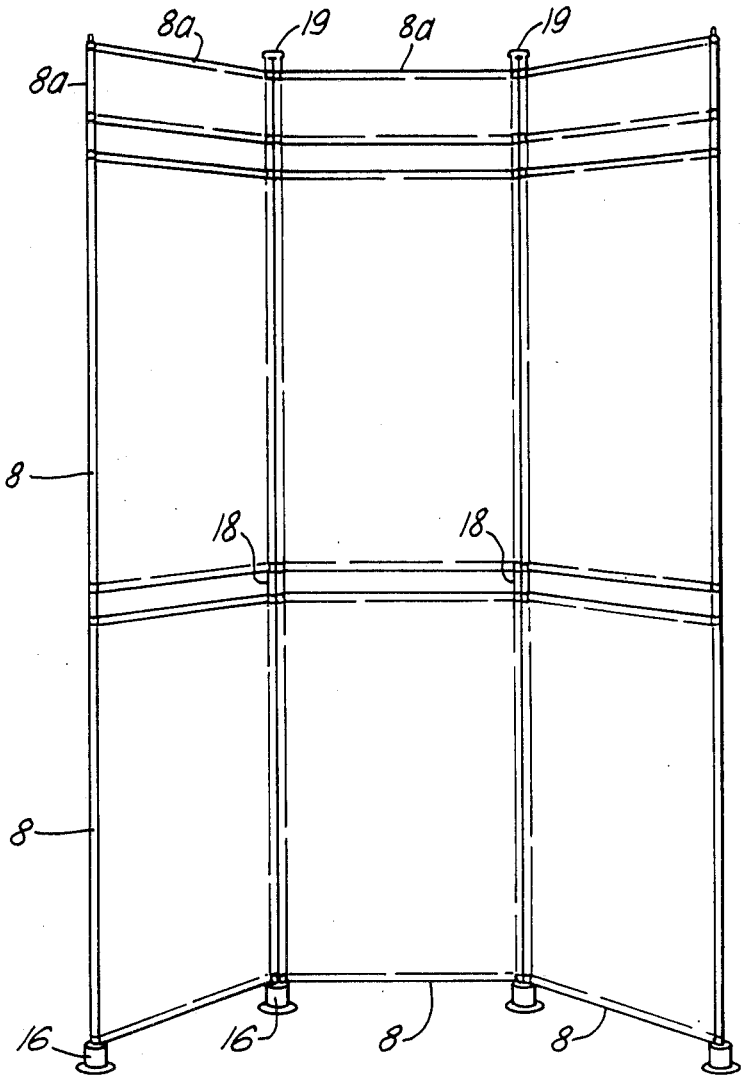
Fig. 1. PRIOR ART
FIG. 1 is a perspective view of a structure of the kind specified to which the invention may be applied.
Figure 2:
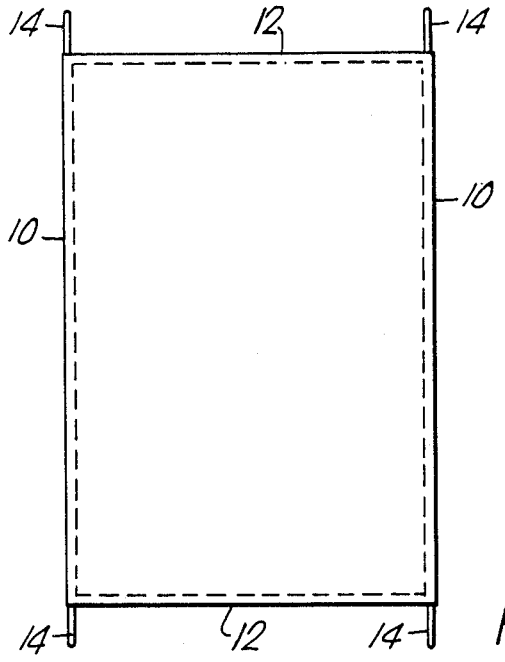
Fig. 2. PRIOR ART
FIG. 2 is an elevation view of a frame forming part of the structure of FIG. 1, FIGS. 3*a* to 3*d* are detail perspective views illustrating the assembly of the structure of FIGS. 1 and 2 and details of the construction thereof.
Figure 3A:
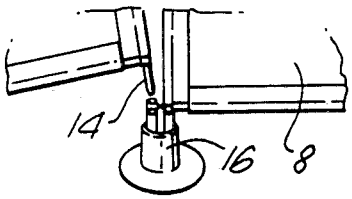
Fig. 3a. PRIOR ART
Figure 3B:
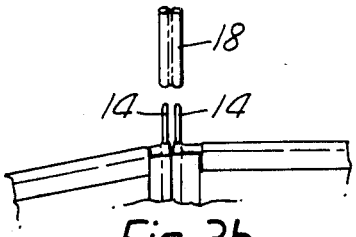
Fig. 3b. PRIOR ART
Figure 3C:
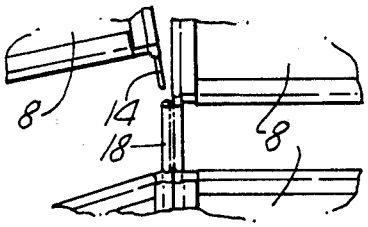
Fig. 3c. PRIOR ART
Figure 3D:
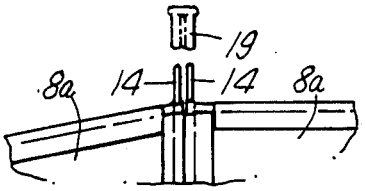
Fig. 3d. PRIOR ART

Referring to FIGS. 1 to 3*d*, the structure shown is of the type described in our British Patent Specifications Nos. 972458 and 1586738 to which reference should be had. Briefly, the structure comprises a plurality of rectangular frames or panels 8 each comprising a basic frame comprising two parallel uprights 10 (FIG. 2) connected adjacent their upper and lower ends by horizontal transverse members 12, the uprights 10 projecting beyond the transverse members 12 at the upper and lower ends of the panels to provide respective spigots 14. More particularly, the structure shown comprises a lower course of frames 8, an intermediate course of identical frames 8, and an uppermost course of frames 8*a*, which are similar in construction to the frames 8, and of the same width, but much less tall.

The lower frames 8 are arranged in a series, vertical edge to vertical edge, and adjacent uprights of adjacent frames are connected at their lower and upper ends by respective connector elements. The intermediate and uppermost frames 8, 8*a* are similarly interconnected in respective series. Furthermore, each frame of the intermediate course is directly above a respective frame of the lower course and has its upright in vertical alignment with the respective uprights of the respective frame of the lower course, and likewise each frame 8*a* of the uppermost course is directly above a respective frame of the intermediate course and has its uprights in vertical alignment with the respective uprights of the respective frame of the intermediate course. Thus, the uprights of the frames are disposed in vertical arrays, each comprising an upright of a lower frame, the vertically aligned upright of the intermediate frame directly above, and the vertically aligned upright of the uppermost frame at the top of the structure.

In assembly of the structure, as illustrated in FIGS. 3*a* to 3*d*, each of the lowermost frames 8 is initially connected at its lower ends to each of the adjoining lowermost frames by inserting the adjoining downwardly projecting spigots 14 of the adjoining frames into respective upwardly open sockets provided by a base member 16, (FIG. 3*a*) constituting a first form of connector element, whilst in a similar manner adjoining frames 8 are connected at their upper ends by tubular connectors 18 which, in their simplest form, comprise, in effect, two parallel metal tubes united with one another and receiving respective upwardly projecting spigots 14 of the adjoining uprights of the adjoining frames 8 (FIG. 3*b*) and in this manner the panels of the lower course are linked together at their upper and lower ends adjacent their vertical edges. In a similar manner, the panels of the intermediate course are fitted above the panels of the lower course, with the downwardly projecting spigots 14 of each panel of the intermediate course being inserted in the upper ends of the bores of the respective connecting members 18 into which project upwardly, from below, the corresponding upwardly projecting spigots 14 of the respective frames of the lower course. In the arrangement shown, the uppermost course of panels 8*a* is assembled in like manner over the intermediate course of panels, the panels 8*a* being linked together at their upper ends by respective top caps 19 each providing two downwardly open sockets to receive the upwardly projecting spigots of the adjacent uprights of adjoining panels 8*a*, the caps 19 constituting a further form of connector element.

Figure 4:
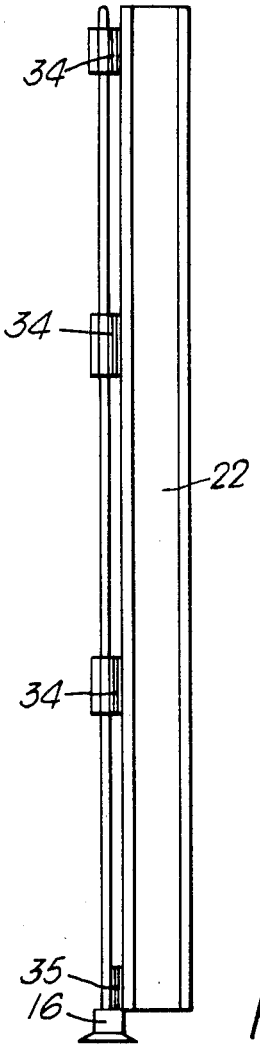
FIG. 4 is an end elevation view of a structure corresponding to that of FIGS. 1 to 3*d* incorporating stabilising means and embodying the invention.
Figure 5:
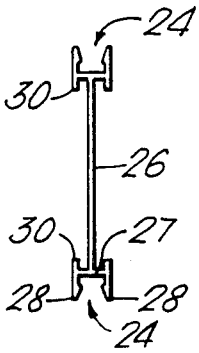
FIG. 5 is a sectional view of a vertical rail forming the stabilising means.

Referring to FIG. 4, in a corresponding structure embodying the invention, in the region of at least one pair of adjoining said vertical arrays of uprights, instead of the frames 8, 8*a* being inter-connected by first connector elements such as 18, 19, which are entirely independent of one another, the connecting elements associated with the respective pair of vertical arrays of uprights are secured to a respective vertical bracing rail 22, normally disposed on the side of the structure which is not intended to be exposed to view. Each rail 22 is in the form of an extrusion, for example of aluminum alloy, of the cross-sectional form shown in FIG. 5, providing a planar central web 26 and, adjacent either edge of the web 26, similar channel formations 24, the open sides of the channel formations facing the opposite directions, parallel with the plane of the central web 26. Each channel formation includes a base wall 27 forming the bottom of the respective channel and extending perpendicular to the web 26 and side portions 28 defining the sides of the channel and extending generally parallel with the web 26. Each of the side portions 28 is extended past the base wall 27 in the direction towards the other channel formation to provide flanges 30 on either side of the web 26. The channel afforded by each channel formation 24 includes a portion adjacent the base wall 27 which is relatively wide in the direction perpendicular to the plane of web 26 and a portion, extending from said relatively wide portion to the mouth of the channel, which is somewhat narrower, but flares so as to increase in width from the junction with the wider portion to the mouth of the channel. Thus, each channel has an approximately T-section interior profile. The rail 22 is arranged with one channel 24 adjacent the frames 8, 8*a* and the web 26 extending from that channel, away from the frames 8, 8*a* to the other channel 24.

Figure 7:
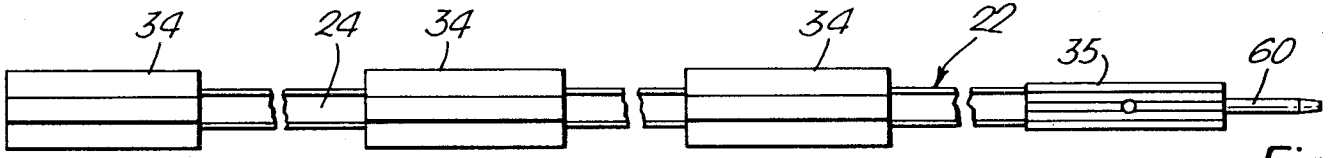
Figure 6:
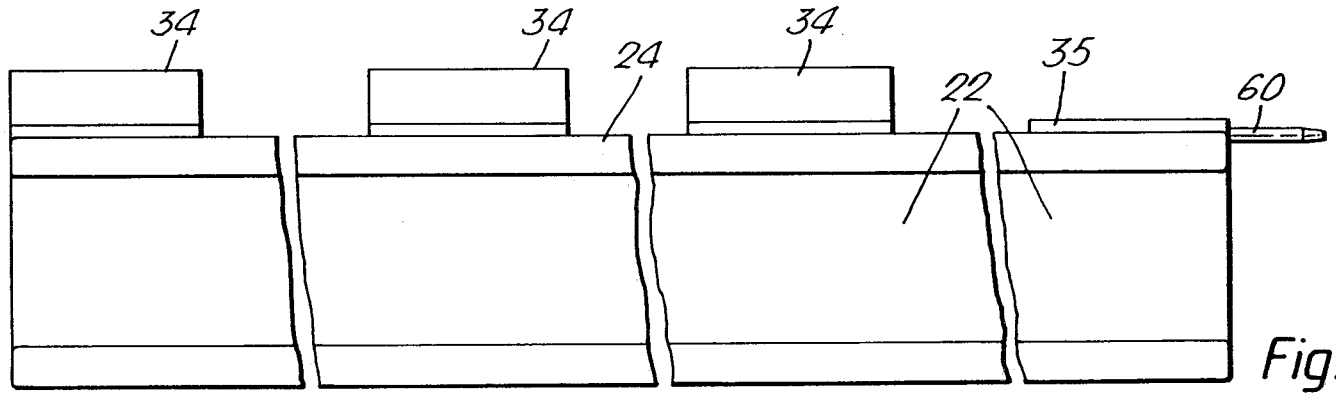
FIG. 6 is a partial, broken view, and FIG. 7 a corresponding edge view showing the rail of FIG. 5 with connector elements applied thereto.
Figure 10:
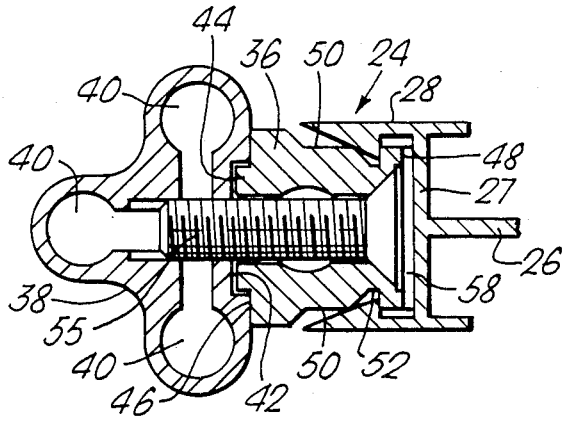

The rectangular panels 8, 8*a* of the structure are secured to the rail 22 by way of second connector elements 34 (FIGS. 4, 6 and 7), which replace one or more of the vertical arrays of the first connector elements 18, 19 in the arrangement in accordance with FIGS. 1 to 3*d*. FIG. 10 shows the cross-sectional form of one such connector element. The particular element shown in FIG. 10 is of composite form and comprises a first part 36 engaging in the respective channel formation 24 nearer the panels and a three-way socket element 38, secured to the element 36 and providing three vertically extending parallel passages 40 each in the form of a cylindrical bore interrupted by a slot, with the slots intercommunicating with one another.

Figure 11:
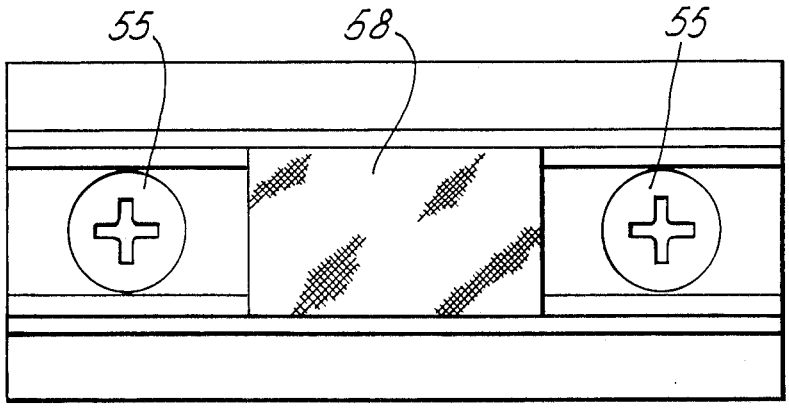
FIG. 10 is a cross-sectional view of another connector element and FIG. 11 is an elevation view of the connector element of FIG. 10.

The bore of each of the passages 40 is of a diameter to receive snugly, from above and/or below, a spigot 14. The element 38 also has, on its exterior, on one face thereof, a shallow channel 42, which receives a corresponding rib or key 44 provided on member 36. On either side of the key 44, the member 36 provides shoulders 46 which engage the opposing external face of the member 38. At its side remote from the member 38, the member 36 is generally rectangular in cross-section having an edge face 48 parallel with shoulders 46 and, perpendicular thereto, side faces 50 parallel with one another. The transverse spacing between the two faces 50 is somewhat greater than the minimum transverse width of the channel in the channel member 24, but somewhat less than the transverse width of the portion of the channel rearest the base part 27 and each face 50, adjacent the end face 48, is provided with a respective groove 52 which accommodates the inwardly projecting edge of the sloping portion of the channel wall which defines, with the corresponding opposing channel portion, the flaring part of the channel. The member 36 is thus held captive in the channel member 24 and extends out of the mouth of the channel member to the member 38. In the arrangement shown, the member 38 is secured to the member 36 by means of screws 55 received in transverse bores in the member 36 and in screw-threaded engagement with screw-threaded bores formed in the member 38, the heads of the screws 55 being countersunk in a shallow channel formed in the edge face 48 of member 36. Also secured in this shallow channel, between the heads of the two screws 55, is a strip 58 (FIG. 11) of resilient fabric adhesively secured to the member 36 and providing a resilient pile bearing against the opposing face of the base part 27 to take up clearance between the face 48 and the base part 27 and hold the member 36 firmly in the channel. The member 36, with the member 38 secured thereto, is slid into the channel 24 from one end of the rail.

The members 36 and 38 are preferably formed from lengths cut off respective aluminium extrusions of the cross-sectional forms shown. In use, in an arrangement such as shown in FIG. 1, where each course of frames 8, 8*a* consists of only a single series of frames, at the location of the pair of vertical arrays of uprights connected by connector elements 34 with the rail, the uprights of the two arrays may be aligned with, and their spigots 14 inserted in, the passages 40 which are on laterally opposite sides of each element 38, or one array of uprights may be aligned with and their spigots 14 inserted in, the central passages 40 of the elements 38 and the uprights of the other array of the pair may be aligned with, and have their spigots 14 inserted in, one of the two other sets of passages 40. Furthermore three vertical rows of frames 8, 8*a* disposed in respective ones of three planes radiating from the vertical axis of the connector elements 38 of the same rail, may be connected with their respective uprights adjacent one another by said uprights being aligned with and having their spigots 14 inserted in, respective ones of the three passages 40 in each of the elements 38. Alternatively a rail 22 may be disposed at a vertical edge of the structure with only a single array of uprights connected with the rail by having their spigots 14 inserted in only one of the three sets of passages 40 of the elements 34.

Figure 8:
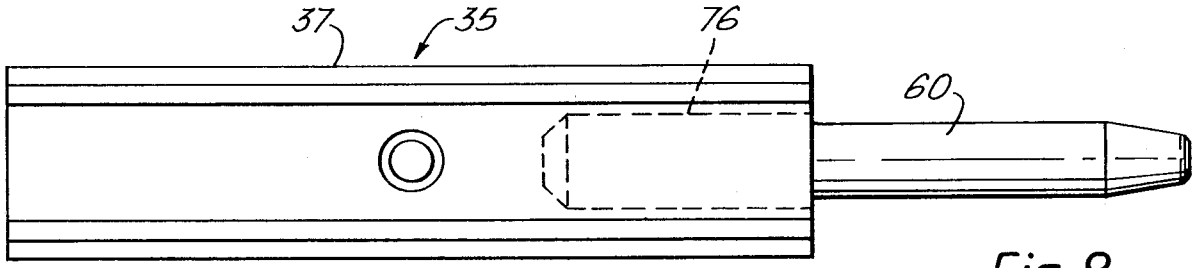
FIG. 8 is an elevation view of one form of connector element.
Figure 9:
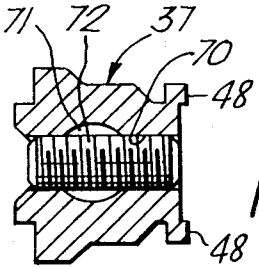
FIG. 9 is a cross-sectional view of the connector element of FIG. 8.

If desired, the members 36 and 38 may be formed integrally with one another, as a single extrusion, in which case, of course, the screws 55 are dispensed with. In order to locate the lower end of the rail 22 with respect to the base member 16 which receives the spigots 14 at the lower ends of the pair of vertical arrays of upright connected with the rail, the lower end of the rail 22 may be provided with a connector element 35 which as shown in FIGS. 8 and 9 comprises a portion 37, similar to the member 36, engaged in the respective channel 24 and a spigot 60 projecting from one end of member 37 and of the same dimensions as one of the spigots 14. In use, the spigot 14 is simply engaged in a respective unoccupied socket in the multisocket base 16.

As shown in FIG. 9, the portion 37 has a cross-sectional form similar to that of member 36 and indeed, in a variant, may have exactly the same cross-section. The portion 37 is again preferably a length cut from an aluminium extrusion of the cross-sectional form shown. The cross-section of portion 37, and indeed that of member 36, has a cylindrical through passage which may, if desired, be intersected by a slot extending to the edge face of the portion remote from the channel 24. The exterior form of the part of portion 37 which is received in the channel 24 is substantially the same as that of member 36 which is so received and will therefore not be described in detail. A screw-threaded transverse bore is formed through the portion 37 and receives a clamping screw 72 which, after the portion 37 has been received in the channel 24 may be screwed up to engage the base of the channel 24 and clamp the member 37 in position. The spigot has an enlarged head portion 76 (indicated in dotted lines) which is externally knurled and which is force fitted in the cylindrical through passage 71. In a variant arrangement, particularly where members 36 and 38 are replaced by corresponding integral members 34 cut from a single extrusion, each connector element 35 may be of simplified form, with the exterior of that portion of the element 35 which lies on the side, remote from edge face 48, of an axial plane parallel with face 48, being formed as part of a cylinder co-axial with passage 71, the last-noted plane being, for example, a plane in which lies the axis of passage 71.

Referring to FIG. 1, it will be noted that there is a substantial gap between the lower transverse member of each uppermost frame 8*a* and the upper transverse member of the intermediate frame 8 immediately below. Similar gaps between the intermediate and lower frames 8 are filled by filling pieces which comprise lengths cut from the same extrusion as that from which the rail 22 is cut, the channels 24 in the case of such a filling piece facing upwardly and downwardly and respectively receiving the lower transverse member of the respective upper frame 8 and the upper transverse member of the respective lower frame 8. Strips of card of the like, for example bearing advertising material may be fitted in front of the central web, with the edges of such strips being located behind the flanges 30 on the front of the filling piece extrusion.

Furthermore, it is possible to fit to one or the other side of such a filling piece, or to one or the other side of the vertical support rail 22, a cover member of sheet material formed into a channel with the side walls of the channel, at their edges remote from the base of the channel, terminating in outwardly turned flanges, coplanar with one another, which engage behind the flanges 30 of the filling piece or vertical support rail, whilst the side walls of the channel provided by the cover member extend past the flanges 30, away from the web 26, to the base of the channel. The cover member, of uniform cross-section throughout its length, is dimensioned to fit snugly in the extrusion (filling piece or rail 22) in the unstressed state of the cover member, and may be either resilient, for example of resilient plastics, to allow it to be resiliently deformed and "snapped" into place behind the flanges 30, or may be slid into the filling piece or rail 22 longitudinally from one end.

In such an arrangement, the cover member defines, with the respective filling piece or rail 22, a length of trunking within which electrical cables may be led. It will be appreciated that such filling pieces may, of course, be disposed in the gaps between the uppermost frames 8*a* and the intermediate frames 8 and may likewise be fitted with such cover members to form trunking.

In a variant, similar cover members, of an appropriate width measured transversely of the channel formed by the cover member (i.e. vertically) may be fitted behind a frame or panel such as the frames 8, 8*a*, with the lower outwardly turned flange engaged between the panel and the flange 28 of a channel 24 which receives the lower edge of the panel and with the upper outwardly turned flange engaged between the panel and the flange 28 of a channel 24 which receives the upper edge of the panel, so that a trunking passage is defined between the panel and the base and side walls of the channel. This arrangement is, of course, more likely to be favoured where the panels in question are, like the panels 8*a*, of limited height.

I claim:

1. A structure comprising a plurality of panels, each panel including a frame around its periphery, each frame comprising two uprights and two transverse members, each said upright having extensions projecting beyond the transverse members of the same panel at upper and lower ends of the panel, each said extension forming an element of a spigot and socket connection, a plurality of said frames being disposed one above the other so that the uprights of the frames are disposed in vertical arrays, each array comprising a plurality of such uprights in longitudinal alignment with one another, the structure further including a plurality of first connector elements interconnecting the frames and engaging said projecting extensions of said uprights and affording the complementary elements of said spigot and socket connections, the structure incorporating stabilizing means comprising a vertical column having a channel formation of substantially constant cross-section throughout its length disposed adjacent and parallel with at least one said vertical array of uprights, a plurality of second connector elements engaged with said column and each providing at least one element of a spigot and socket connection receiving the complementary element of such a spigot and socket connection constituted by a said extension of said upright of the respective vertical array, at least one of said second connector elements providing the connection between opposing extensions of aligned uprights of two vertically superimposed panels, and affording respective elements of spigot and socket connections of each of said two panels with that connector element, each of said second connector elements including attachment means slidably engaging the channel formation to permit controlled movement of each of said second connector elements in a vertical direction and to prohibit movement of said connector elements in a transverse direction relative to said column, said channel formation further having a mouth and a relatively wide portion relatively remote from said mouth and a narrower portion nearer to said mouth, and wherein said attachment means of each said second connector element includes a part of substantially uniform cross-sectin including a portion engaged in said channel, said portion engaged in said channel having a relatively wide part, engaged in said relatively wide portion of the channel in said column and too wide to pass through said narrower portion, and a relatively narrow part passing through said narrower portion of said channel to the remainder of the connector element, and wherein said channel has a base and said portion of the second connector element engaged in said channel has a base opposing said channel base, and including friction retaining means comprising a piece of fabric, secured to said base of said connector element portion, said fabric having a resilient pile bearing against the face of the opposing base of said channel to take up a clearance space between the base of said connector element portion and the base of the channel and hold the connector element in place frictionally in the channel.

2. A structure according to claim 1 including at least one said second connector element which comprises two discrete, releasably connected parts, comprising a first part engaged with said column and a second part, providing a said element of a said spigot and socket connection and means releasably securing the second part to said first part.

3. A structure according to claim 1 wherein a said second connector element provides a plurality of adjoining parallel sockets and wherein a plurality of adjoining said panels have said spigots thereof engaged in respective said adjoining parallel sockets.

4. A structure comprising a plurality of panels, each panel including a frame around its periphery, each frame comprising two uprights and two transverse members, each said upright having extensions projecting beyond the transverse members of the same panel at upper and lower ends of the panel, each said extension forming an element of a spigot and socket connection, a plurality of said frames being disposed one above the other so that the uprights of the frames are disposed in vertical arrays, each array comprising a plurality of such uprights in longitudinal alignment with one another, the structure further including a plurality of first connector elements interconnecting the frames and engaging said projecting extensions of said uprights and affording the complementary elements of said spigot and socket connections, the structure incorporating stabilizing means comprising a vertical column having a channel formation of substantially constant cross-section throughout its length disposed adjacent and parallel with at least one said vertical array of uprights, and plurality of second connector elements engaged with said column and each providing at least one element of a spigot and socket connection receiving the complementary element of such a spigot and socket connection constituted by a said extension of a said upright of the respective vertical array, at least one of said second connector elements providing the connection between opposing extensions of aligned uprights of two vertically superimposed panels, and affording respective elements of spigot and socket connections of each of said two panels with that connector element, each of said second connector elements including attachment means slidably engaging the channel formation to permit controlled movement of each of said second connector elements in a vertical direction and to prohibit movement of said connector elements in a transverse direction relative to said column and wherein said column is approximately I-shaped in cross-section, comprising a flat web extending between enlarged edge portions, one of said edge portions carrying said channel formation for engaging the second connector elements.

5. A structure according to claim 4 including at least one second connector element which comprises two discrete, releasably connected parts, comprising a first part engaged with said column and a second part, providing a said element of a said spigot and socket connection and means releasably securing the second part to said first part.

6. A structure according to claim 4 wherein a said second connector element provides a plurality of adjoining parallel sockets and wherein a plurality of adjoining said panels have said spigots thereof engaged in respective said adjoining parallel sockets.

7. A structure according to claim 4, including, for each said second connector element, friction retaining means providing a frictional force action between said connector element and its vertical column to hold the connector element in place while permitting vertical movement of said second connector element along the column when an external force is applied to said connector element.

* * * * *

UNITED STATES PATENT AND TRADEMARK OFFICE

CERTIFICATE OF CORRECTION

PATENT NO. : 4,653,563

DATED : March 31, 1987

INVENTOR(S) : Brian C. Bannister

It is certified that error appears in the above-identified patent and that said Letters Patent is hereby corrected as shown below:

On the title page, Item [73] should -- Marler Haley Exposystems Limited
Exposystems House, Hertfordshire,
England --.

Signed and Sealed this

Eighth Day of December, 1987

*Attest:*

DONALD J. QUIGG

*Attesting Officer*

*Commissioner of Patents and Trademarks*